US011832769B2

(12) United States Patent
Zeng

(10) Patent No.: US 11,832,769 B2
(45) Date of Patent: Dec. 5, 2023

(54) MULTIPURPOSE TOILET ROLL HOLDER APPARATUS

(71) Applicant: Qingding Zeng, Shanghai (CN)

(72) Inventor: Qingding Zeng, Shanghai (CN)

( * ) Notice: Subject to any disclaimer, the term of this patent is extended or adjusted under 35 U.S.C. 154(b) by 35 days.

(21) Appl. No.: 17/571,552

(22) Filed: Jan. 10, 2022

(65) Prior Publication Data

US 2023/0109410 A1 Apr. 6, 2023

Related U.S. Application Data

(60) Provisional application No. 63/252,645, filed on Oct. 6, 2021.

(51) Int. Cl.
*A47K 10/40* (2006.01)

(52) U.S. Cl.
CPC ..... *A47K 10/40* (2013.01)

(58) Field of Classification Search
USPC ..... 242/598
See application file for complete search history.

(56) References Cited

U.S. PATENT DOCUMENTS

| | | | | |
|---|---|---|---|---|
| 3,848,822 A * | 11/1974 | Boone | A47K 10/40 | 242/590 |
| 5,464,170 A * | 11/1995 | Mitchell | A47K 10/40 | 242/598 |
| 5,718,404 A * | 2/1998 | Greer | A47K 10/40 | 242/598.2 |
| 6,439,501 B1 * | 8/2002 | Harmathy | A47K 10/38 | 242/596.7 |
| 8,201,770 B2 * | 6/2012 | Dermo | B65H 75/08 | 242/598.2 |

* cited by examiner

*Primary Examiner* — William A. Rivera

(57) ABSTRACT

The present invention concerns improvements in and relating to toilet roll holder apparatus to accommodate toilet rolls of conventional diameter as well as any greater diameter along with preventing unnecessary wastage of the toilet rolls, and downward pivotal movement of the toilet roll, wherein the toilet roll holder apparatus comprises pairs of extender adapters of two different sizes, wherein one pair is of small-sized extender adapters for accommodating a toilet roll having the larger diameter than the toilet roll having the predetermined diameter and another pair is of large-sized extender adapters for accommodating a more larger than the toilet roll having the larger diameter which larger than the toilet roll having the predetermined diameter roll. The multipurpose toilet roll holder apparatus of the present invention also comprises a spindle for rotatably supporting any size of the toilet roll by holding the toilet roll firmly in place.

10 Claims, 7 Drawing Sheets

MULTIPURPOSE TOILET ROLL HOLDER APPARATUS

CROSS-REFERENCE TO RELATED APPLICATIONS

This application claims the benefit of U.S. Provisional Application No. 63/252,645, filed on Oct. 6, 2021.

FIELD OF THE INVENTION

The present invention relates primarily to a toilet roll holder, and more particularly it relates to a simple yet unique, improved multipurpose toilet roll holder apparatus including two pairs of extender adapters and a spindle, designed specifically to accommodate a standard toilet roll, as well as a large & X-large toilet rolls having diameter greater than conventional diameter of the standard toilet roll, thereby extends holding capacity of the toilet roll holder.

BACKGROUND OF THE INVENTION

Paper towels and/or toilet papers are one of the basic sanitary needs and have been used since years in most of households as well as commercial spaces. A variety of toilet roll holders have been used to accommodate the paper towels and/or toilet paper rolls. Typically, the toilet roll holder is comprised of a U-shaped bracket or duel post structure attachable to a wall or cabinet with a spring-loaded telescoping member extending between the opposing arms thereof for rotatably supporting a roll of toilet paper. In the commercial spaces, usage of the paper towels and/or toilet papers is significantly higher than the households, and more usage and constant need of replacement is resulted into production of large sized toilet roll having diameter greater than standard toilet rolls, which therefore cannot be accommodated by the regular sized toilet roll holder. Therefore, having just a regular sized toilet roll holder is counter-productivity because of utilization of the large sized toilet roll.

Various prior arts have been disclosed in order to attempt and solve the aforesaid problem as this is a crowded field. A prior art U.S. Pat. No. 8,201,770B2 to Mario S. Dermo describes an apparatus for increasing the roll diameter capacity of a toilet paper roll holder, wherein the apparatus uses elongate extenders which are adhesively attached to the inside surfaces of a conventional roll holder. Further, the apparatus uses simple links which are attached by pins to the existing spindle receptacles in the roll holder. The links may be substantially permanently attached to the ends of a telescopic spindle.

Another prior art U.S. Pat. No. 3,834,636A to R Linick describes an apparatus for adapting existing wall mounted toilet tissue support fixtures of the type having opposed, inwardly facing roll support sockets to receive toilet tissue rolls of larger than standard diameter, wherein the apparatus includes extensible support bars, the inner ends of which are mounted in existent fixtures, the outer ends of which receive the tissue roll, and strut means which may be variably positioned to enable the apparatus to be accommodated to varying dimensional characteristics of existing fixtures.

Although there are many solutions available in the market to extend holding capacity of the toilet roll holder, they do not adequately solve or provide a viable solution to the current problem. The applicant is unaware of any such apparatus or system which hold and support the toilet roll of conventional diameter as well as any greater diameter. More specifically, there is no such toilet roll holder apparatus known in the prior art that accommodates the toilet roll of conventional diameter as well as larger diameter via two pairs of extender adapters which are replaceable and interchangeable. Further, there is no such toilet roll holder apparatus known in the prior art that prevents unnecessary wastage of the toilet roll. Furthermore, there is no such toilet roll holder apparatus known in the prior art that holds the toilet roll firmly in place and makes spindle movement more deliberate. Moreover, there is no such toilet roll holder apparatus known in the prior art that limits the amount of downward pivotal movement of the toilet roll.

The conventional apparatuses are mainly focused on increasing the holding capacity of the toilet roll holder. On the other hand, the present invention discloses about a practical solution that provides an improved multipurpose toilet roll holder apparatus which comprises pairs of extender adapters in two different sizes to accommodate the toilet roll of conventional diameter as well as any greater diameter. Also, the present invention discloses about prevention of unnecessary wastage of the toilet roll, and downward pivotal movement of the toilet roll. The unique characteristics and features of the present invention are therefore, unrepresented within the conventional apparatuses. Hence, the present invention has been disclosed to provide solutions to the aforementioned needs, and to resolve the aforementioned deficiencies in the conventional methods and apparatuses.

SUMMARY OF THE INVENTION

The present invention concerns improvements in and relating to toilet roll holder apparatus to accommodate toilet rolls of conventional diameter as well as any greater diameter along with preventing unnecessary wastage of the toilet roll, and downward pivotal movement of the toilet roll, wherein the improved multipurpose toilet roll holder apparatus comprises two pairs of extender adapters and a spindle, designed specifically to accommodate a standard toilet roll, a large toilet roll, and an X-large toilet roll, wherein the large toilet roll and the X-large toilet roll having diameter greater than conventional diameter of the standard toilet roll.

The primary objective of the present invention is to provide an improved multipurpose toilet roll holder apparatus which addresses the needs which were not fulfilled by the conventional apparatuses.

Another objective of the present invention is to provide an improved multipurpose toilet roll holder apparatus which comprises two pairs of extender adapters of different sizes, wherein one pair is of small-sized extender adapters for accommodating a standard toilet roll and a large toilet roll, and another pair is of large-sized extender adapters for accommodating an X-large toilet roll.

Still another objective of the present invention is to provide an improved multipurpose toilet roll holder apparatus which expands the distance between spindle axis and a wall in order to accommodate a large toilet roll and an X-large toilet roll.

Still another objective of the present invention is to provide an improved multipurpose toilet roll holder apparatus which comprises two pairs of extender adapters of different sizes that are replaceable and interchangeable.

Still another objective of the present invention is to provide an improved multipurpose toilet roll holder apparatus which comprises two pairs of extender adapters of different sizes that can be removably attached with a conventional toilet roll holder.

Still another objective of the present invention is to provide an improved multipurpose toilet roll holder apparatus which comprises two pairs of extender adapters of different sizes that can be removably attached with a conventional spindle.

Still another objective of the present invention is to provide an improved multipurpose toilet roll holder apparatus which comprises a spindle to rotatably support a standard toilet roll or a large toilet roll or an X-large toilet roll.

Still another objective of the present invention is to provide an improved multipurpose toilet roll holder apparatus which comprises a spindle that can be removably attached with a conventional toilet roll holder.

Still another objective of the present invention is to provide an improved multipurpose toilet roll holder apparatus which prevents unnecessary wastage of toilet roll papers.

Still another objective of the present invention is to provide an improved multipurpose toilet roll holder apparatus which holds a standard toilet roll or a large toilet roll or an X-large toilet roll firmly in place and makes the spindle movement more deliberate.

Still another objective of the present invention is to provide an improved multipurpose toilet roll holder apparatus which limits the amount of downward pivotal movement of a standard toilet roll or a large toilet roll or an X-large toilet roll.

The summary is provided to introduce representative objectives of the invention in a simplified form that are further described below in the detailed description. This summary is not intended to identify key features or essential features of the claimed subject matter, nor is it intended to be used in any way that would limit the scope of the claimed subject matter.

BRIEF DESCRIPTION OF DRAWINGS

Other objects, advantages and novel features of the invention will become apparent from the following detailed description of the present embodiment when taken in conjunction with the accompanying drawings. These figures are not intended to limit the scope of the present invention but rather illustrate certain attributes thereof.

Figure 1:
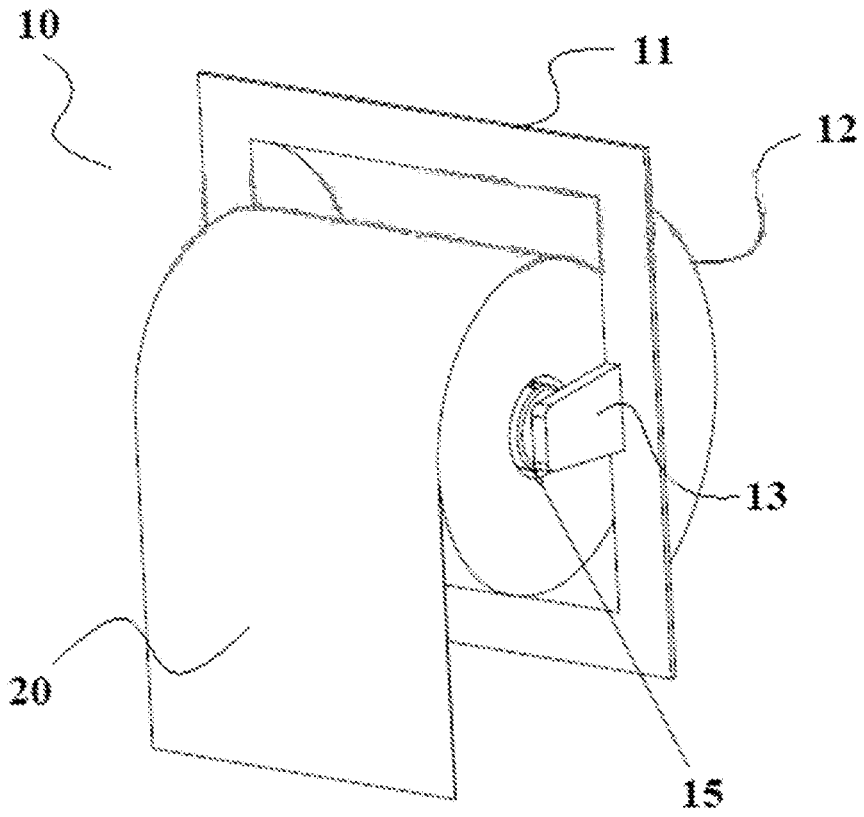
FIG. 1 (Prior art)
FIG. 1 illustrates a perspective view of a conventional toilet roll holder apparatus holding a standard toilet roll.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION OF THE INVENTION

The foregoing disclosure has broadly outlined the features and technical advantages of the present disclosure in order that the description of the disclosure that follows may be better understood. It should be appreciated by those skilled in the art that the conception and specific embodiment disclosed may be readily utilized as a basis for modifying or designing other structures for carrying out the same purposes of the present disclosure. The novel features which are believed to be characteristic of the disclosure, both as to its organization and method of operation, together with further objects and advantages will be better understood from the following description.

Before explaining the present invention in detail, it is to be understood that the invention is not limited in its application to the details of the construction and arrangement of parts illustrated in the accompanying drawings. The invention is capable of other embodiments, as depicted in different figures as described above and of being practiced or carried out in a variety of ways. It is to be understood that the phraseology and terminology employed herein is for the purpose of description and not of limitation.

For the purposes of the description, a phrase in the form "A/B" or in the form "A and/or B" or in the form "at least one of A and B" means (A), (B), or (A and B), where A and B are variables indicating a particular object or attribute. When used, this phrase is intended to and is hereby defined as a choice of A or B or both A and B, which is similar to the phrase "and/or". Where more than two variables are present in such a phrase, this phrase is hereby defined as including only one of the variables, any one of the variables, any combination of any of the variables, and all of the variables, for example, a phrase in the form "at least one of A, B, and C" means (A), (B), (C), (A and B), (A and C), (B and C), or (A, B and C).

It is to be understood that the term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

It is to be understood that the present invention describes two pairs of extender adapters of different sizes i.e. a pair of small-sized extender adapters and a pair of large-sized extender adapters, wherein both the pairs are exchangeable with each other throughout the disclosure unless otherwise specified.

The present invention discloses an improved multipurpose toilet roll holder apparatus which includes two pairs of extender adapters of different sizes, wherein each pair is configured to be removably attached with the toilet roll holder, in order to accommodate a standard toilet roll and/or a large/X-large toilet roll having diameter greater than conventional diameter of the standard toilet roll.

Reference will now be made in detail to preferred embodiments of the present invention, an example of which is illustrated in the accompanying drawings.

A conventional toilet roll holder apparatus 10 without any extender component is illustrated in FIG. 1. Turning to FIG. 1, the conventional toilet roll holder apparatus 10 is shown which comprising a frame 11; a receptacle 12; a pair of side members 13, 14; and a spindle 15 disposed between the side members 13, 14, wherein the spindle 15 is configured to hold a standard toilet roll 20. As shown in FIG. 1, the conventional toilet roll holder apparatus 10 is well applicable for the standard toilet roll 20, but it is not compatible when it comes to a large and/or X-large toilet roll which has diameter greater than diameter of the standard toilet roll 20. Therefore, the present invention has disclosed a practical solution to overcome aforesaid shortcomings along with other technical innovative features which are elaborated in the following pages of description.

Figure 2:
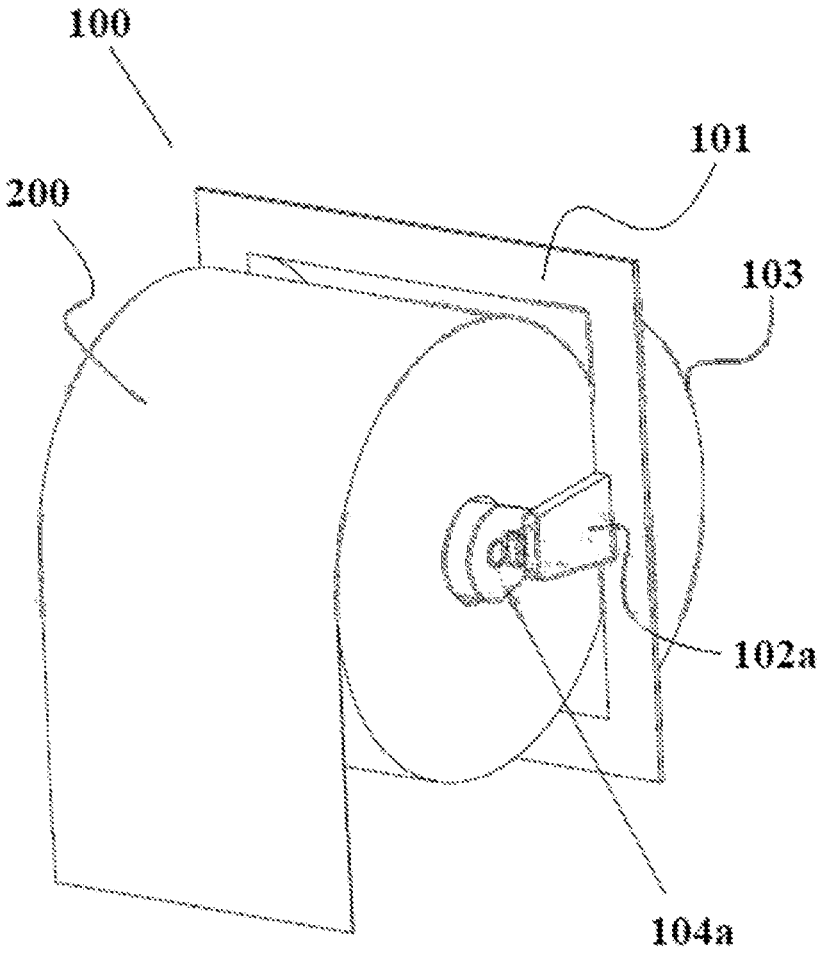
FIG. 2 illustrates a perspective view of an improved multipurpose toilet roll holder apparatus showing a pair of large-sized extender adapters holding an X-large toilet roll, according to an embodiment of the present invention.

According to a first preferred embodiment of the present invention, a perspective view of an improved toilet roll holder apparatus 100 holding an X-large toilet roll 200 is shown in FIG. 2. Turning to FIG. 2, the toilet roll holder apparatus 100 comprising: a frame 101 provided with a parallelly spaced side members 102*a*, 102*b*, wherein the side members 102*a*, 102*b* are perpendicular to the frame 101 and extend in forward direction; a semi-circular receptacle 103 configured to allow in a half portion of the X-large toilet roll 200, wherein the semi-circular receptacle 103 may comprise a fixing means to securely fix the toilet roll holder apparatus 100 to a wall; and a pair of extender adapters comprising a right extender adapter 104*a* and a left extender adapter 104*b*, each configured to removably attach to the respective side members 102*a*, 102*b*, wherein the pair of extender adapters 104*a*, 104*b* extends holding capacity of the toilet roll holder apparatus 100 or of any existing toilet roll holder apparatus which is described in the following pages of description.

According to abovementioned embodiment of the present invention, the pair of extender adapters 104*a*, 104*b* is a large-sized extender adapters 104*a*, 104*b*. However, the present invention discloses two pairs of extender adapters 104*a*, 104*b* of different sizes, wherein one pair has a small-sized extender adapters 104*a*, 104*b* for accommodating the standard toilet roll 20 and a large toilet roll which has diameter greater than the standard toilet roll 20, and another pair which described in abovementioned first preferred embodiment has the large-sized extender adapters 104*a*, 104*b* for accommodating the X-large toilet roll 200 which has diameter greater than both, the standard toilet roll 20 and the large toilet roll.

According to an embodiment of the present invention, a relative distance between a spindle axis and the wall has been expanded in order to accommodate the large toilet roll and the X-large toilet roll 200.

According to an embodiment of the present invention, the fixing means is not limited in its nature and it can be selected from any known fixing method or fixing apparatus or fixing means.

Figure 3:
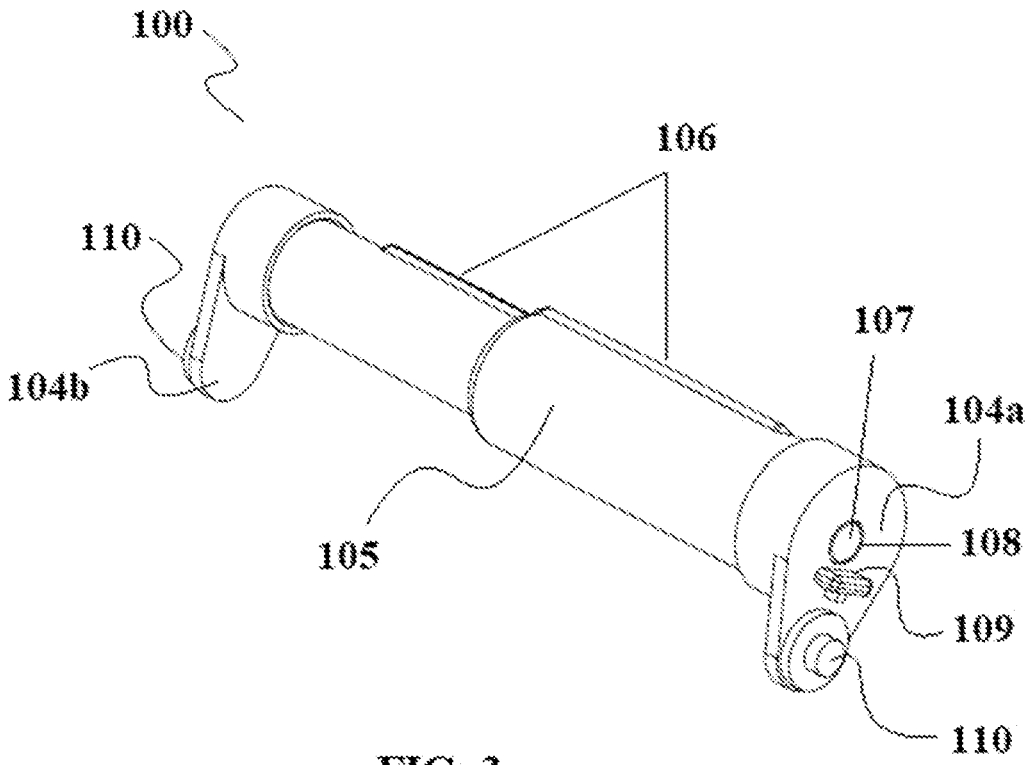
FIG. 3 illustrates a detailed perspective view of an improved multipurpose toilet roll holder apparatus showing one of the pairs of extender adapters and a spindle assembly, according to an embodiment of the present invention.

According to a second preferred embodiment of the present invention, a detailed perspective view of various parts of the toilet roll holder apparatus 100 is shown in FIG. 3. Now referring to FIG. 3, the toilet roll holder apparatus 100 is further comprising: a spindle 105 formed of an inner elongated hollow member and an outer elongated hollow member, both slideably coupled together via a spring disposed there between, wherein the spindle 105 is configured to removably attach within the pair of extender adapters 104*a*, 104*b* to rotatably support the X-large toilet roll 200, wherein the X-large toilet roll 200 can be mounted on the spindle 105 in traditional manner; an anti-rotation locking hump 106 formed over an outer surface of both the elongated hollow members of the spindle 105, designed in such a way that the anti-rotation locking hump 106 of the inner elongated hollow member gets stuck with an inner slot of the anti-rotation locking hump 106 of the outer elongated hollow member while sliding into it, hence the inner elongated hollow member cannot move or rotate with respect to the outer elongated hollow member when coupled together and therefore holds the X-large toilet roll 200 firmly in place and makes the spindle movement more deliberate; a standard-sized protrusion 107 provided at both end of the spindle 105 configured to be removably engaged with a standard-sized aperture 108 provided in each of the extender adapters 104*a*, 104*b* in order to make snug fitting with the pair of extender adapters 104*a*, 104*b*, wherein the standard-sized protrusions 107 can also be removably engaged directly with side members of any conventional toilet roll fixture; a brake component 109 provided on an outer surface of any one extender adapter from each pair of extender adapters 104*a*, 104*b*, configured to control an oscillatory movement of the pair of extender adapters 104*a*, 104*b* with respect to the side members 102*a*, 102*b*, wherein the brake component 109 allows user to limit the amount of downward pivotal movement of the X-large toilet roll 200 to support rotation and prevent anti-rotation of the X-large toilet roll 200 while in use, which in turn prevents unnecessary wastage of toilet roll papers; and multiple sized protrusions 110 provided on an outer elongated surface of each of the pair of extender adapters 104*a*, 104*b*, configured to establish a removable attachment with the side members 102*a*, 102*b*, wherein the multiple sized protrusions 110 also allow the user to removably attach the pair of extender adapters 104*a*, 104*b* with the side members of any conventional toilet roll fixture. The multiple sized protrusions 110 having at least two protrusions of different diameters and formed one above another, in order to establish the removable attachment with any possible diameter of aperture provided in the side members of any conventional toilet roll apparatus.

According to an embodiment of the present invention, the brake component 109 includes a rectangular block and a square block right beneath the rectangular block, located below the standard-sized aperture 108 of the right extender adapter 104*a* as shown in FIG. 3. However, the location of the brake component 109 is not limited below the standard-sized aperture 108, and it can be located anywhere, either above or right side or left side of the standard-sized aperture 108, for the ease of manufacturing. Further, the brake component 109 may include only a rectangular block as far as the goal is fulfilled. Moreover, the brake component 109 can be located either on the right extender adapter 104*a* or on the left extender adapter 104*b*.

Figure 4:
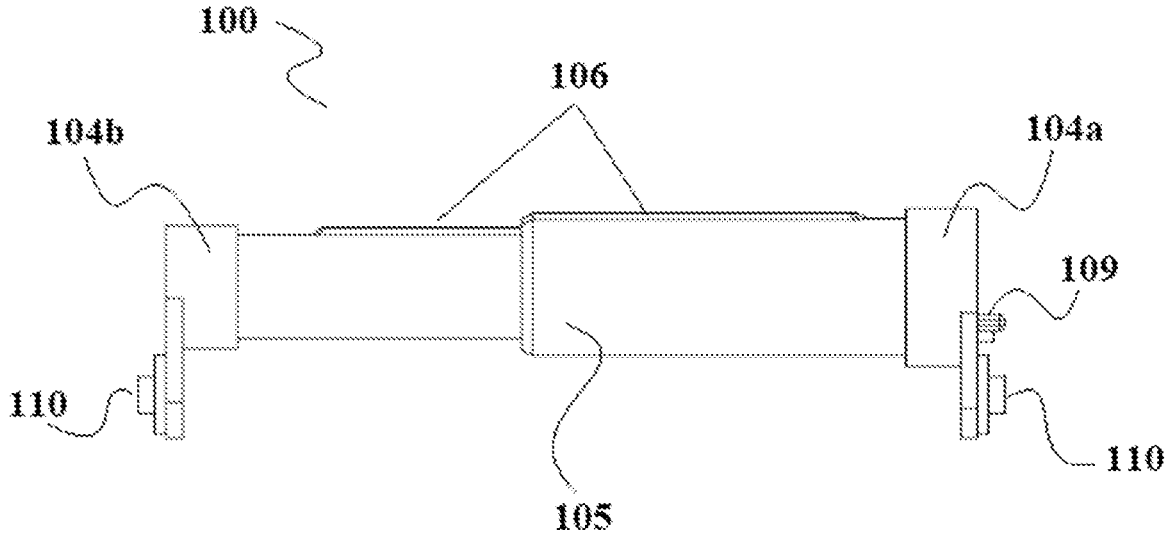
FIG. 4 illustrates a detailed front view of an improved multipurpose toilet roll holder apparatus showing one of the pairs of extender adapters and a spindle assembly, according to an embodiment of the present invention.

According to a third preferred embodiment of the present invention, a detailed front view of various parts of the toilet roll holder apparatus 100 including one of the pairs of extender adapters 104*a*, 104*b* and the spindle 105 is shown in FIG. 4.

Figure 5:
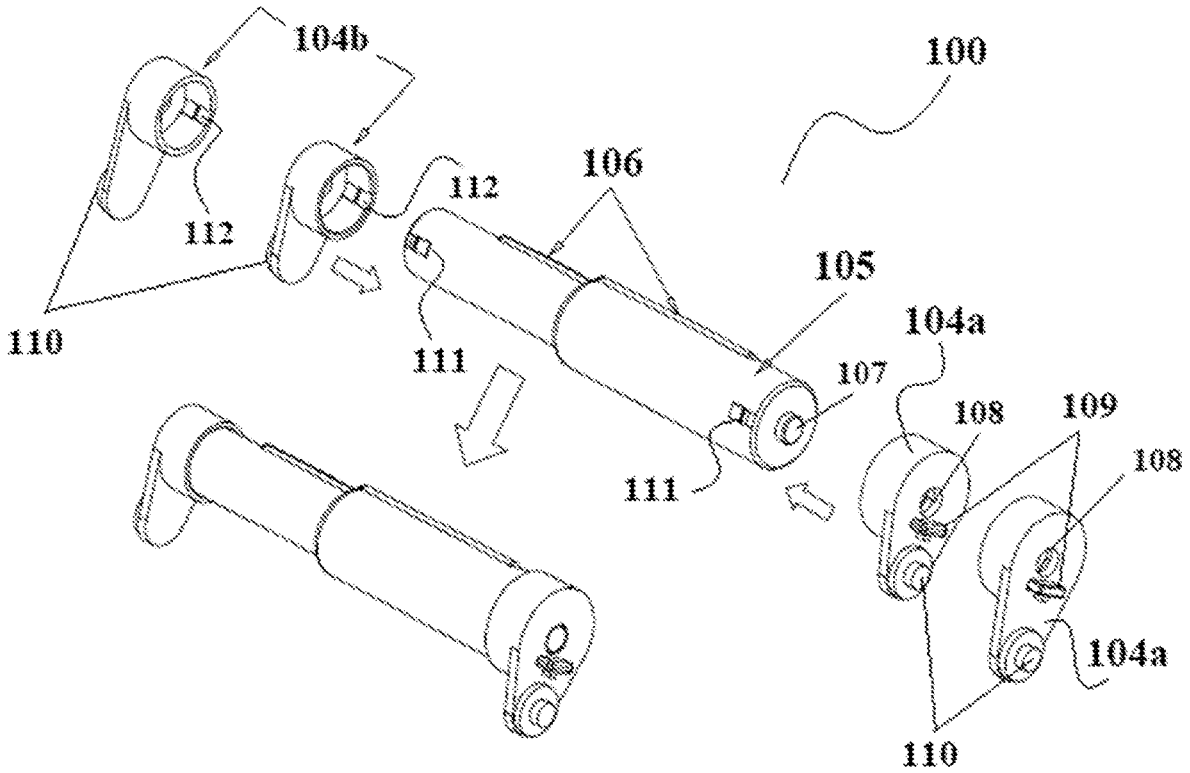
FIG. 5 illustrates an exploded perspective view of an improved multipurpose toilet roll holder apparatus showing both pairs of extender adapters and a spindle assembly, according to an embodiment of the present invention.

According to a fourth preferred embodiment of the present invention, an exploded view of various parts of the toilet roll holder apparatus 100 including both the pairs of extender adapters 104*a*, 104*b* and the spindle 105 is shown in FIG. 5. Referring to FIG. 5, the relationship and/or order of assembly of various parts including the pairs of extender adapters 104*a*, 104*b* and the spindle 105 is clearly shown. Further referring to FIG. 5, the toilet roll holder apparatus 100 is comprising: snap hooks 111 provided on the outer surface of the spindle 105 at both ends, wherein each end has a pair of the snap hooks 111 projecting out in opposite direction from each other. The snap hooks 111 are configured to removably engage with receiving grooves 112 of the pair of extender adapters 104*a*, 104*b*. The receiving grooves 112 are engraved in inner surface of each of the pair of extender adapters 104*a*, 104*b*, wherein each of the pairs of extender adapters 104*a*, 104*b* has a pair of the receiving grooves 112 facing towards each other. While engaging the snap hooks 111 with the receiving grooves 112, each pair of the snap hooks 111 must be aligned with the respective pair of the receiving grooves 112 for a proper mating there between to support desirable function of the toilet roll holder apparatus 100. Moreover, FIG. 5 also shows both the pairs of extender adapters 104*a*, 104*b* of different sizes which is described in detail in further embodiment of the present invention.

Figure 6:
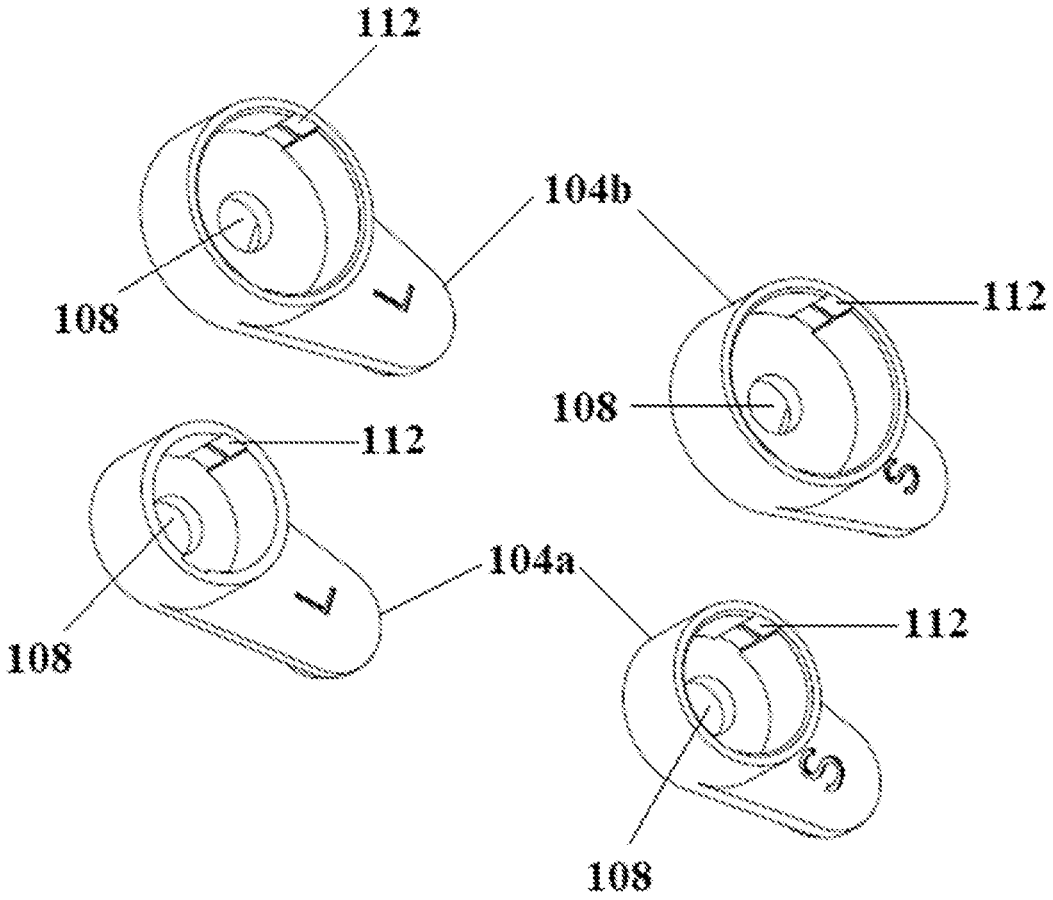
FIG. 6 illustrates a detailed perspective view of an improved multipurpose toilet roll holder apparatus showing both pairs of extender adapters, according to an embodiment of the present invention.

According to a fifth preferred embodiment of the present invention, a detailed perspective view of both the pairs of extender adapters 104*a*, 104*b* of the toilet roll holder apparatus 100 is shown in FIG. 6. Referring to FIG. 6, both the pairs of extender adapters 104*a*, 104*b* in two different sizes are shown, wherein the pair of small-sized extender adapters 104*a*, 104*b* is applicable for the large toilet roll as well as the standard toilet roll, and the pair of large-sized extender adapters 104*a*, 104*b* is applicable for the X-large toilet roll 200 having diameter greater than the diameter of the large toilet roll and the standard toilet roll. The pair of large-sized extender adapters 104*a*, 104*b* may be at least 1 inch longer than the pair of small-sized extender adapters 104*a*, 104*b*. Both the pairs of extender adapters 104*a*, 104*b* are replaceable and/or interchangeable based on the diameter of the toilet rolls. The other parts of the extender adapters 104*a*, 104*b* such as, the standard-sized apertures 108, and the receiving slots 112 are clearly visible in FIG. 6. In addition, the pair of large-sized extender adapters 104*a*, 104*b* may be indicated with letter "L", and the pair of small-sized extender adapters 104*a*, 104*b* may be indicated with letter "S", in order to identify the different sizes of the extender adapters 104*a*, 104*b* while making selection based on the diameter of the toilet rolls.

Figure 7:
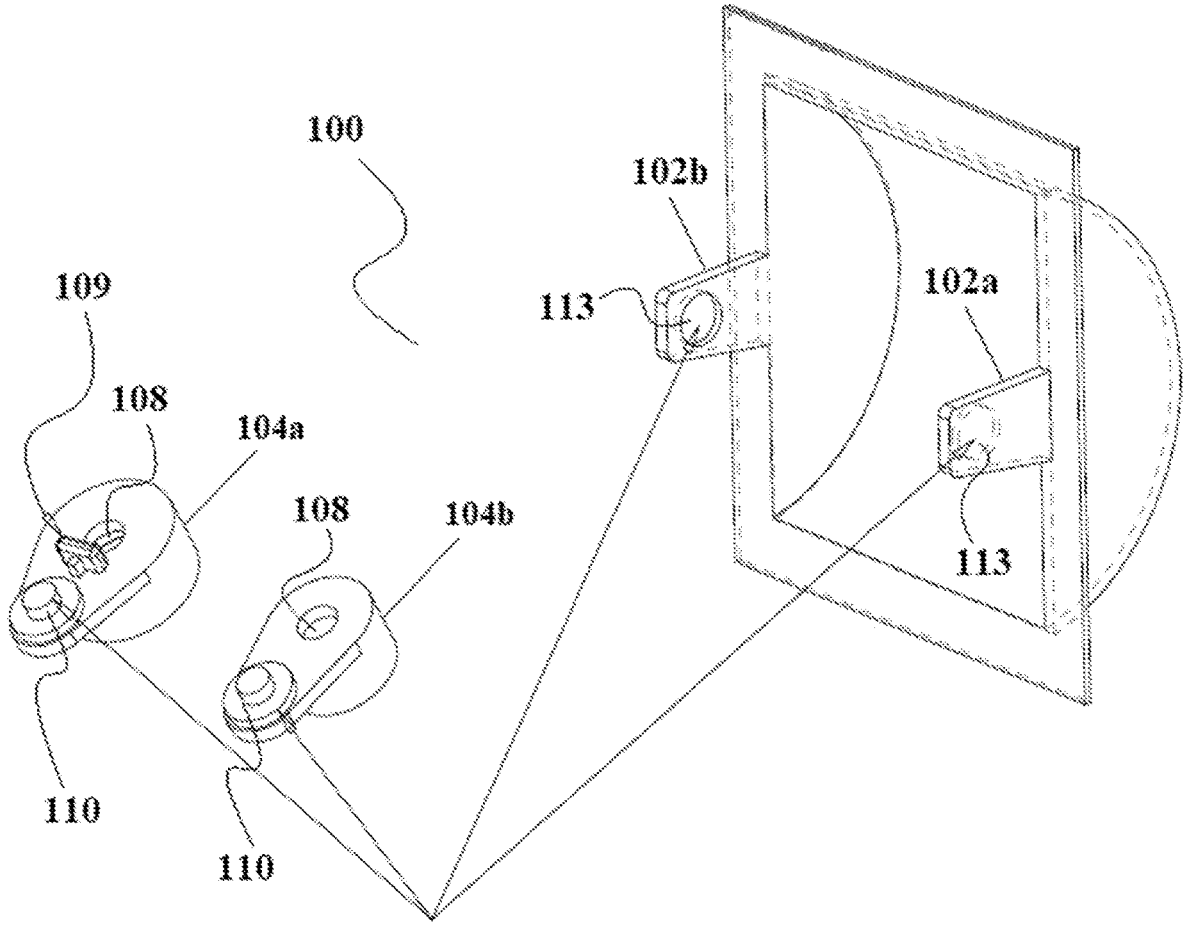
FIG. 7 illustrates a detailed perspective view of an improved multipurpose toilet roll holder apparatus showing an attachment means to removably attach one of the pairs of extender adapters with side members, according to an embodiment of the present invention.

According to a sixth preferred embodiment of the present invention, a detailed perspective view of an attachment means to removably attach one of the pairs of extender adapters 104*a*, 104*b* with the side members 102*a*, 102*b* of the toilet roll holder apparatus 100 is shown in FIG. 7. Turning to FIG. 7, the toilet roll holder apparatus 100 is comprising: an indentation or depression 113 provided in an inner wall of each of the side members 102*a*, 102*b* which allows to sit or fix the respective extender adapters 104*a*, 104*b* via the multiple sized protrusions 110 for establishing the removable attachment there between.

Figure 8A:
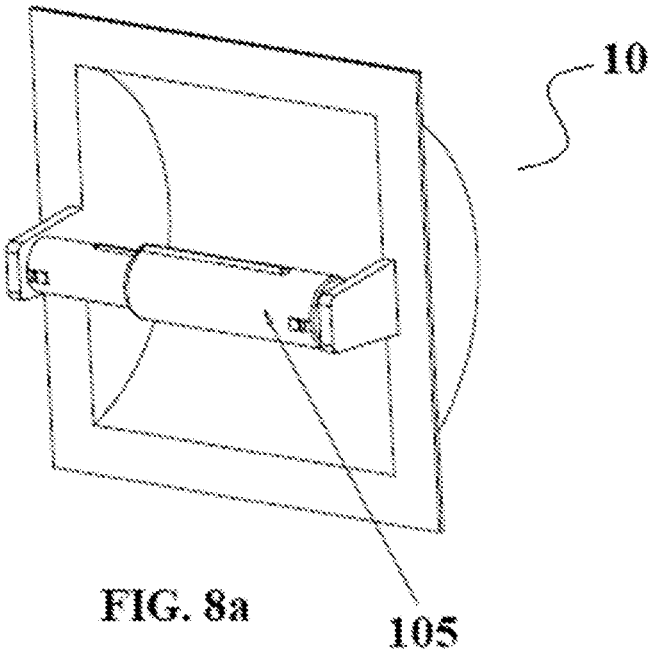
FIGS. 8*a* & 8*b* illustrates a detailed perspective view of a spindle of the present invention removably attached with a conventional toilet roll holder apparatus holding a standard toilet roll, according to an embodiment of the present invention.
Figure 8B:
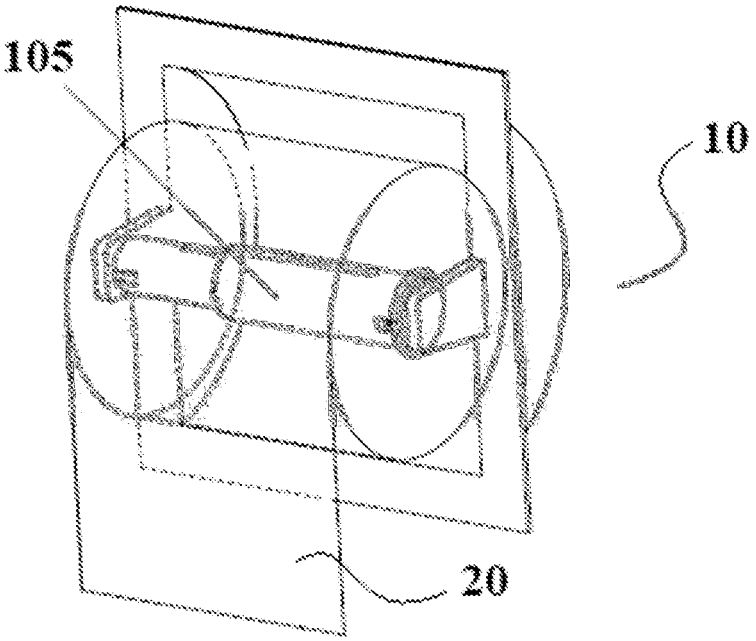

According to a seventh preferred embodiment of the present invention, a detailed perspective view of the spindle 105 without any pair of extender adapters 104*a*, 104*b*, attached with the conventional toilet roll holder apparatus 10 is shown in FIGS. 8*a* & 8*b*. Turning to FIGS. 8*a* & 8*b*, it is clearly depicted that the spindle 105 of the present invention can also be removably connected on the conventional toilet roll holder apparatus 10 without the need of attaching any pair of extender adapters 104*a*, 104*b*. This embodiment is highly relevant for the households where the usage of the paper towels and/or toilet papers is significantly lower than the commercial spaces, hence they generally use the standard toilet roll 20. Thus, for holding the standard toilet roll 20 firmly in place and making the spindle movement more deliberate, the spindle 105 plays major role due to the anti-rotation locking hump 106 of the spindle 105.

According to an embodiment of the present invention, the toilet roll holder apparatus 100 can also be used as a standard toilet paper holder without assembling or attaching any pair of the extender adapters 104*a*, 104*b* based on the user requirements.

According to an embodiment of the present invention, the two pairs of the extender adapters 104*a*, 104*b* and the spindle 105 of the toilet roll holder apparatus 100 can be implemented on any conventional toilet paper roll fixture having opposed arms or posts adapted to receive any spindle.

According to an embodiment of the present invention, the two pairs of the extender adapters 104*a*, 104*b* of the toilet roll holder apparatus 100 can also be removably attached with a conventional spindle.

According to an embodiment of the present invention, both the pairs of extender adapters 104*a*, 104*b* in different sizes are interchangeable which allow to use any size of toilet rolls, selected from, but not limited to, the standard toilet roll 20, the large toilet roll, and the X-large toilet roll 200.

The improved multipurpose toilet roll holder apparatus of the present invention including the two pairs of the extender adapters in different sizes and the spindle is highly advantageous and well applied as compared to the conventional toilet roll holder apparatuses. The simple and unique design of the extender adapters and the spindle allows removable yet firm attachment which serves a desirable function of holding and supporting the toilet roll of conventional diameter as well as any greater diameter. Moreover, the present invention prevents the unnecessary wastage of the toiler roll papers, and also allows the user to limit the amount of downward pivotal movement of the toilet roll. Most importantly, the present invention described herein aims to provide a solution that is practical, which can be implemented into a viable commercial success.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

The invention has been explained in relation to specific embodiment. It is inferred that the foregoing description is only illustrative of the present invention, and it is not intended that the invention be limited or restrictive thereto. Many other specific embodiments of the present invention will be apparent to one skilled in the art from the foregoing disclosure. All substitution, alterations and modification of the present invention which come within the scope of the following claims are to which the present invention is readily susceptible without departing from the spirit of the invention. The scope of the invention should therefore be determined not with reference to the above description but should be determined with reference to appended claims along with full scope of equivalents to which such claims are entitled.

I claim:

1. An improved multipurpose toilet roll holder apparatus, said apparatus comprising:

two pairs of extender adapters, each pair comprising a right extender adapter and a left extender adapter, wherein each extender adapter is configured to removably attach to side members of a frame accommodating a toilet roll having a predetermined diameter, a spindle configured to removably attach within any of the pairs of extender adapters to hold and rotatably support the toilet roll having the predetermined diameter, an anti-rotation locking hump provided over an outer surface of the spindle; designed to hold the toilet roll having the determined diameter firmly in place and make the spindle movement more deliberate;

a protrusion provided at both end of the spindle configured to be removably engaged with an aperture of each of the extender adapters in order to make snug fitting with the pair of extender adapters;

a brake component provided on an outer surface of any one extender adapter from each pair of extender adapters, configured to control an oscillatory movement of the pair of extender adapters with respect to the side members;

multiple sized protrusions provided on an outer elongated surface of each of the extender adapters, configured to establish a removable attachment with the side members;

snap hooks provided on the outer surface of the spindle at both ends, configured to removably engage with receiving grooves of each of the pair of extender adapters; and an indentation provided in an inner wall of each of the side members which allows to fix the respective pair of extender adapters via the multiple sized protrusions for establishing the removable attachment there between, wherein: both the pairs of extender adapters extend holding capacity of the toilet roll holder apparatus in order to accommodate a toilet roll having a larger diameter than the toilet roll having the predetermined diameter, wherein one of the pairs of extender adapters accommodates the toilet roll having the predetermined diameter.

2. The apparatus of claim 1, wherein a fixing means is provided to securely mount the toilet roll holder apparatus to a wall.

3. The apparatus of claim 1, wherein one of the pairs of extender adapters comprising a small-sized extender adapters for accommodating the toilet roll having the predetermined diameter, and another pair comprising a large-sized extender adapters for accommodating the toilet roll having the larger diameter than the toilet roll having the predetermined diameter.

4. The apparatus of claim 1, Wherein both the pairs of extender adapters are interchangeable and replaceable based on the diameter of the toilet roll.

5. The apparatus of claim 1, wherein a relative distance between a spindle axis and the wall is expanded in order to accommodate the toilet roll having the predetermined diameter and the toilet roll having the larger diameter than the toilet roll having the predetermined diameter.

6. The apparatus of claim 1, wherein the brake component allows user to limit the amount of downward pivotal movement of the toilet roll to support rotation and prevent anti-rotation of the toilet roll while in use, which in turn prevents unnecessary wastage of toilet roll papers.

7. The apparatus of claim 1, wherein each end of the spindle has a pair of the snap hooks projecting out in opposite direction from each other.

8. The apparatus of claim 1, wherein the receiving grooves are engraved at an inner surface of each of the extender adapters, in a pair facing towards each other.

9. The apparatus of claim 1, wherein the multiple sized protrusions comprising at least two protrusions of different diameters, formed one above another, in order to establish the removable attachment with any diameter of aperture provided in side members of conventional toilet roll apparatuses.

10. The apparatus of claim 1, wherein the toilet roll can be selected from, but not limited to, the toilet roll having the predetermined diameter and the toilet roll having the larger diameter than the toilet roll having the predetermined diameter.

* * * * *